US006682028B1

(12) United States Patent
Hackal

(10) Patent No.: US 6,682,028 B1
(45) Date of Patent: Jan. 27, 2004

(54) APPARATUS FOR HOLDING CONTAINER IN INVERTED CONFIGURATION

(76) Inventor: Mike Hackal, 220 Hidden Acres Path, Wading River, NY (US) 11792

( * ) Notice: Subject to any disclaimer, the term of this patent is extended or adjusted under 35 U.S.C. 154(b) by 0 days.

(21) Appl. No.: 10/374,815

(22) Filed: Feb. 25, 2003

(51) Int. Cl.[7] ..... A47J 47/16

(52) U.S. Cl. ..... 248/145.3; 141/375; 248/311.3

(58) Field of Search ..... 248/145.3, 311.3, 248/312.1; 220/212, 630, 238.6; 215/228; 141/375, 106, 364

(56) References Cited

U.S. PATENT DOCUMENTS

| | | | | |
|---|---|---|---|---|
| 3,402,844 A | | 9/1968 | Chin | |
| 4,271,878 A | * | 6/1981 | Bologa | 141/375 |
| 4,723,671 A | | 2/1988 | Mears | |
| D307,225 S | | 4/1990 | Freidenfelds | |
| 5,002,246 A | | 3/1991 | Chaffin et al. | |
| 5,071,002 A | | 12/1991 | Bradley | |
| 5,080,150 A | | 1/1992 | Deadwyler, Jr. | |
| 5,105,860 A | | 4/1992 | Connor | |
| 5,505,330 A | * | 4/1996 | Nunes | 220/742 |
| 5,560,406 A | | 10/1996 | Fineroff et al. | |
| 5,634,573 A | | 6/1997 | Steinberg et al. | |
| 5,769,280 A | | 6/1998 | Ehresmann | |
| 6,095,374 A | | 8/2000 | Ricard et al. | |
| D435,711 S | | 12/2000 | Weiser et al. | |
| 6,220,458 B1 | | 4/2001 | Falor | |
| D448,978 S | | 10/2001 | Isbell | |
| 6,345,723 B1 | | 2/2002 | Blake et al. | |
| RE37,566 E | * | 3/2002 | Cristea et al. | 141/98 |
| 6,398,050 B1 | * | 6/2002 | Allora | 215/228 |

* cited by examiner

*Primary Examiner*—Ramon O. Ramirez
(74) *Attorney, Agent, or Firm*—Dale J. Ream

(57) ABSTRACT

An apparatus for holding a viscous liquid container in an inverted configuration includes a base member defining a central recess for receiving the cap of the viscous liquid container in an inverted orientation. An upstanding handle member is attached to the base member and includes telescopic arm elements to accommodate containers of various sizes. A lever is pivotally coupled to an upper end of the handle member that is movable between a first configuration for urging the container toward the base member and a second configuration displaced therefrom for releasing the container. The lever is spring-loaded for movement toward the first configuration. The viscous liquid container may be selectively secured between the base member and lever for storage or use.

18 Claims, 2 Drawing Sheets

APPARATUS FOR HOLDING CONTAINER IN INVERTED CONFIGURATION

BACKGROUND OF THE INVENTION

This invention relates generally to container holding devices and, more particularly, to an apparatus for holding a container of viscous liquid in an inverted orientation by urging the container into a base member.

A condiment having a high viscosity, such as ketchup, pours very slowly from its container, particularly when the container is almost empty. In such an instance, a relatively small volume of the viscous liquid must flow a long distance from the bottom of the container to its spout. This is less of a problem when the container is nearly full in that the flow distance is shorter and the greater weight of the larger volume speeds the flow.

Various devices have been proposed in the art for holding a condiment container in a partially or completely inverted position so as to reduce the flow distance and speed up dispensing. Although assumably effective for their intended purposes, the existing devices do not provide the stability of maintaining downward tension on the container and are not suitable for holding containers of various sizes. Further, the existing devices do not provide an apparatus capable of conveniently holding an inverted container in a variety of locations, such as on a refrigerator shelf, in a refrigerator door, as well as on a tabletop.

Therefore, it is desirable to have an apparatus for holding a viscous liquid container in an inverted position which urges the container downward into a base member cap recess. Further, it is desirable to have an apparatus for holding an inverted container which includes a telescopic handle for use with containers of different lengths.

SUMMARY OF THE INVENTION

An apparatus for holding an inverted container of viscous liquid includes a base member defining a central recess for receiving a cap of the container therein for supporting the container in an inverted orientation. The apparatus further includes a handle member attached to the base member and extending upwardly therefrom. The handle member includes telescopic arm elements such that the apparatus can be used to support and hold liquid containers of various heights. A lever is pivotally coupled to an upper end of the handle member and is pivotally movable between a first configuration extending inwardly relative to the handle member and situated above the base member and a second configuration displaced from the first configuration. More particularly, the lever may be pivotally moved to a position extending outwardly relative to the handle member and situated about 180° from the lever's position at the first configuration. The lever is spring-loaded so as to be biased in the direction of the first configuration. Thus, the lever is normally urged toward contact with a bottom wall of the inverted container so as to urge the container toward the base member, where the bottle's cap is received in the base member recess.

Therefore, a general object of this invention is to provide an apparatus for holding a viscous liquid container in an inverted configuration.

Another object of this invention is to provide an apparatus, as aforesaid, which urges an inverted container toward the base member.

Still another object of this invention is to provide an apparatus, as aforesaid, which can hold containers of various heights in an inverted configuration.

Yet another object of this invention is to provide an apparatus, as aforesaid, for supporting and holding a viscous liquid container on a table surface, in the door of a refrigerator, or on a shelf of a refrigerator.

A further object of this invention is to provide an apparatus, as aforesaid, which can be positioned so as to selectively hold a viscous liquid container in a partially inverted configuration.

A still further object of this invention is to provide an apparatus, as aforesaid, which includes a locking mechanism for selectively holding the lever at a selected configuration.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

An apparatus 10 for holding and supporting a viscous liquid container in an inverted configuration according to the preferred embodiment of the present invention will now be described with reference to FIGS. 1 and 2 of the accompanying drawings.

Figure 1:
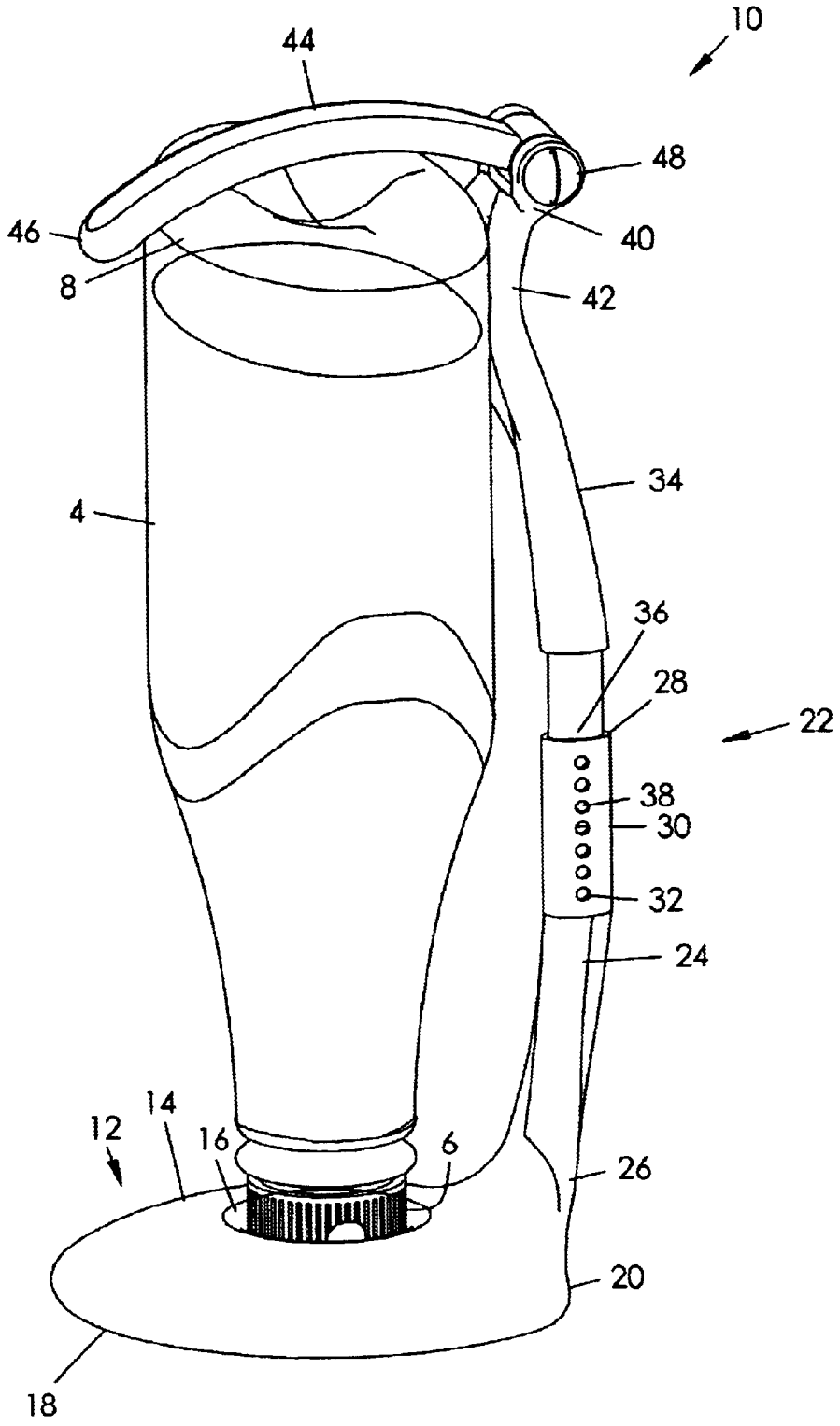
FIG. 1 is a perspective view of an apparatus according to a preferred embodiment of the present invention in an upright configuration.
Figure 2:
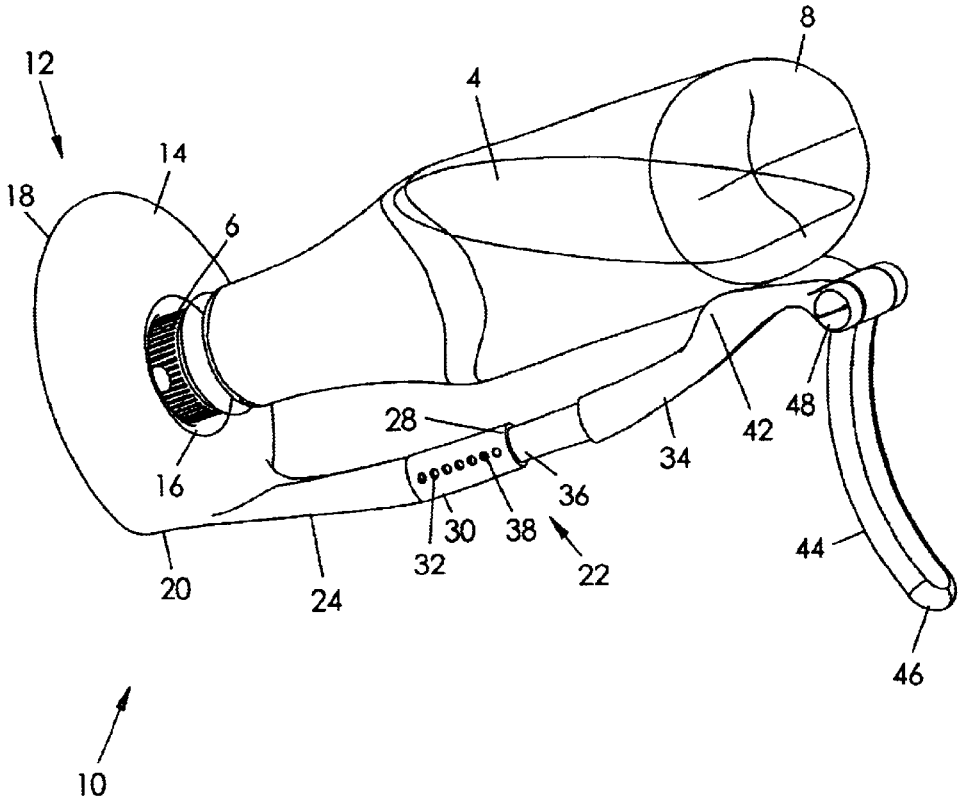
FIG. 2 is another perspective view of the apparatus as in FIG. 1 in a partially upright configuration.

The apparatus 10 includes a base member 12 having a generally circular configuration (FIG. 1). The base member 12 includes a generally planar bottom surface for resting upon a planar supporting surface such as a countertop, table, or refrigerator shelf. The base member 12 further includes an upper portion 14 having a generally conical or dome-shaped configuration although a cubical, oval, or other stable configuration would be suitable.

The upper portion 14 of the base member 12 defines a centrally situated recess 16 having a generally circular configuration and having a diameter slightly larger than a diameter of a viscous liquid container cap 6. Accordingly, the recess 16 may receive a container cap 6 therein for supporting the container 4 in an inverted orientation (FIG. 1). It is understood that the recess 16 does not extend entirely through the base member 12. Instead, the cap 6 is supported by the bottom surface of the base member 12 such that the entire apparatus 10 may be moved from one supporting surface to another without removing or otherwise securing the liquid container 4.

The base member 12 includes a peripheral edge 18 between the bottom surface and upper portion 14. A handle member 22 is fixedly attached to the upper portion 14 of the base member 12 adjacent the peripheral edge 18 although it would be suitable for the base member 12 and handle member 22 to have an integral construction (FIG. 1). More particularly, the handle member 22 includes first 24 and second 34 arm elements having a telescopic construction. A first end 26 of the first arm element 24 is connected to the base member 12 at the peripheral edge 18 and extends upwardly to a second end 28. The first arm element includes a sleeve portion 30 adjacent the second end 28. The sleeve portion 30 is hollow and the second end 28 defines an opening for access to the sleeve portion 30. The sleeve portion 30 defines a plurality of apertures 32 spaced apart longitudinally therealong. The first arm element 24 defines a longitudinal axis extending between the first 26 and second 28 ends. The second arm element 34 includes a lower end 36 having a configuration suitable for being telescopically received into the sleeve portion 30 of the first arm element 24 through the second end 28. The lower end 36 is capable of slidable movement longitudinally therein such that the arm elements may be telescopically lengthened or shortened. The lower end 36 includes a spring-loaded flange 38 situated to selectably mate with one of the sleeve apertures 32. The second arm element 34 includes an upper end 40 opposite the lower end 36.

A lever 44 is pivotally coupled to the upper end 40 of the second arm element 34 of the handle member 22. The lever 44, therefore, is movable about its pivot axis between first and second configurations and includes about a 180 degree range of rotation (FIGS. 1 and 2). More particularly, at the first configuration the lever 44 extends inwardly relative to the handle member 22 and is generally perpendicular thereto. The lever 44 is situated above the base member 12 at the first configuration (FIG. 1). At the second configuration, the lever 44 extends outwardly relative to the handle member 22 and is generally perpendicular thereto. In other words, the lever 44 is pivotally rotated about 180 degrees at the second configuration (FIG. 2) from its position at the first configuration (FIG. 1). The lever 44 is spring-loaded at its pivotal attachment such that it is normally biased toward the first configuration.

The second arm element 34 includes a support section 42 adjacent said upper end 40 thereof having an inwardly curved configuration (FIG. 1). The lever 44 includes a generally arcuate configuration. Accordingly, the lever 44 bears against a bottom wall 8 of a viscous liquid container 4 (when the cap 6 of such a container is received in the base member recess) and urges the container 4 against the support section 42 of the second arm element 34. Thus, these configurations enable the container 4 to be held more securely and with more stability, accordingly.

The apparatus 10 further includes a locking mechanism for holding the lever 44 at a desired configuration. The locking mechanism includes a knob 48 threadably coupled to the lever 44 at the lever's pivot point of attachment to the second arm element 34 (FIG. 1). The knob 48 may be a screw or pin which may be frictionally tightened or loosened against the lever to hold the lever at a desired orientation or release it to move in the biased direction, respectively. Other locking mechanism constructions would also work, such as a ratchet with release button or other gear/pawl arrangement.

In addition, the peripheral edge 18 of the base member 12 includes a linear portion 20 in cooperation with a complementary configuration at the first end 26 of the first arm element 24. The apparatus 10 may be tilted backward such that a free end 46 of the lever 44 and the linear portion 20 of the peripheral edge 18 rest upon a supporting surface for holding a viscous liquid container 4 in a partially-inverted configuration (FIG. 2).

In use, a container 4 of a viscous liquid, such as a ketchup bottle, may be held and supported by the present apparatus 10. Since the apparatus 10 may be sized to hold containers of various heights, the handle member 22 may initially be adjusted according to the height of the container. To do so, the spring flange 38 may be depressed to release from a previously selected aperture 32 so that the first 24 and second 34 arm elements may be moved along the imaginary longitudinal axis defined by the handle member 22. When the arm elements have been adjusted to a height corresponding to the height of the container 4, the flange 38 may again be engaged in a corresponding aperture 32 (FIG. 1). The viscous liquid container 4 may then be inverted such that its cap 6 may be received into the base member recess 16. In this orientation, the lever 44 is biased to bear against the bottom wall 8 of the container 4 so as to urge the container against the support section 42 of the second arm element 34 (FIG. 1). If desired, the apparatus 10 may be moved between a refrigerator door or shelf and a tabletop by grasping the handle member 22 and carrying the apparatus 10. Further, the lever 44 may be pivoted 180° to its second configuration and the apparatus 10 may be tilted to rest upon the free end 46 of the lever 44 and on the linear portion 20 of the peripheral edge 18 (FIG. 2). This orientation may be more convenient for use during a meal at a table.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An apparatus for holding an inverted viscous liquid container of a type having a cap or spout, comprising:

a base member defining a central recess for seating the cap of the viscous liquid container when the viscous liquid container is in an inverted orientation;

a handle member having a first end attached to said base member and extending upwardly therefrom to a second end; and a lever pivotally coupled to said second end of said handle member for selective movement between a first configuration bearing against a bottom wall of the viscous liquid container and a second configuration pivotally displaced from said first configuration.

2. The apparatus as in claim 1 wherein said handle member defines a longitudinal axis and includes:

a first arm element defining a plurality of apertures; and a second arm element telescopically received in said first arm element for movement along said longitudinal axis, said second arm element having a flange for selectably engaging one of said apertures.

3. The apparatus as in claim 1 wherein said recess includes a generally circular configuration having a diameter slightly larger than a diameter of the cap of the viscous liquid container for seating the cap in said recess.

4. The apparatus as in claim 1 wherein:

in said second configuration, said lever is situated about 180 degrees from said first configuration; and said base member includes a generally circular configuration having a peripheral edge, said peripheral edge having a linear portion adjacent said first end of said handle member, whereby to selectively rest said linear portion and a free end of said lever upon a supporting surface when said lever is in said second configuration.

5. The apparatus as in claim 1 further comprising spring means for biasing said lever toward said first configuration.

6. The apparatus as in claim 1 further comprising means for releasably locking said lever at a selected configuration.

7. The apparatus as in claim 1 wherein said handle member includes a support section adjacent said second end thereof having an inwardly curved configuration for stabilizing the viscous liquid container.

8. An apparatus for holding a bottle containing a viscous liquid in an inverted configuration, comprising:

a base member having a generally planar bottom surface for resting upon a supporting surface, said base member having a generally circular configuration defining a central recess for receiving a cap of said bottle therein, whereby to support said bottle in an inverted orientation;

a first arm element having a first end fixedly attached to said base member and extending upwardly to a second end, said first arm element having a sleeve portion adjacent said second end and defining an opening at said second end, said sleeve portion defining a plurality of apertures therealong;

a second arm element having a lower end telescopically received through said opening for longitudinal movement in said sleeve, said second arm element having a flange adjacent said lower end for selectably engaging one of said apertures of said sleeve, said second arm element having an upper end opposite said lower end;

a lever pivotally coupled to said upper end of said second arm element for selective movement between a first configuration situated to bear against a bottom wall of said bottle and a second configuration pivotally displaced from said first configuration; and wherein said lever is biased toward said first configuration.

9. The apparatus as in claim 8 wherein said recess includes a generally circular configuration having a diameter slightly larger than a diameter of said cap of said bottle for selectively seating said cap in said recess.

10. The apparatus as in claim 8 wherein:

said base member includes a peripheral edge having a linear portion adjacent said first end of said first arm element; and said lever extends outwardly from said second arm element and is generally perpendicular thereto at said second configuration, whereby to selectively rest said linear portion of said base member peripheral edge and a free end of said lever on said supporting surface for holding said bottle at a partially inverted orientation.

11. The apparatus as in claim 10 further comprising means for releasably locking said lever at said second configuration.

12. The apparatus as in claim 8 further comprising means for releasably locking said lever at a selectable configuration.

13. The apparatus as in claim 8 wherein said second arm element includes a support section adjacent said upper end of said second arm element, said support section having an inwardly curved configuration for bearing against said bottle for enhanced stability.

14. The apparatus as in claim 13 wherein said lever includes a generally arcuate configuration for urging said bottle toward said support section when said lever is at said first configuration and said cap of said bottle is received in said recess.

15. An apparatus for holding a bottle containing a viscous liquid in an inverted configuration, comprising:

a base member having a generally planar bottom surface for resting upon a supporting surface, said base member having a generally circular configuration defining a central recess for receiving a cap of said bottle therein, whereby to support said bottle in an inverted orientation;

a first arm element having a first end fixedly attached to said base member and extending upwardly to a second end, said first arm element having a sleeve portion adjacent said second end and defining an opening at said second end, said sleeve portion defining a plurality of apertures therealong;

a second arm element having a lower end telescopically received through said opening for longitudinal movement in said sleeve, said second arm element having a flange adjacent said lower end for selectably engaging one of said apertures of said sleeve, said second arm element having an upper end opposite said lower end;

a lever pivotally coupled to said upper end of said second arm element for selective movement between first and second configurations, said lever extending above said base member and generally perpendicular to said first and second arm elements at said first configuration for bearing against a bottom wall of said bottle, said lever extending outwardly from said second arm element and generally perpendicular thereto at said second configuration;

spring means for biasing said lever toward said first configuration; and means for releasably locking said lever in said first or second configuration.

16. The apparatus as in claim 15 wherein said base member includes a peripheral edge having a linear portion adjacent said first end of said first arm element, whereby to selectively rest said linear portion of said base member peripheral edge and a free end of said lever upon said supporting surface for holding said bottle at a partially inverted orientation.

17. The apparatus as in claim 15 wherein said second arm element includes a support section adjacent said upper end of said second arm element, said support section having an inwardly curved configuration for bearing against said bottle for enhanced stability.

18. The apparatus as in claim 17 wherein said lever includes a generally arcuate configuration for urging said bottle toward said support section when said lever is at said first configuration and said cap of said bottle is received in said recess.

* * * * *